US008716617B2

(12) United States Patent
Wasielewski

(10) Patent No.: US 8,716,617 B2
(45) Date of Patent: May 6, 2014

(54) ACTIVATION SWITCH FOR A POWER TOOL

(75) Inventor: Kevin Wasielewski, Downers Grove, IL (US)

(73) Assignee: Robert Bosch GmbH, Stuttgart (DE)

( * ) Notice: Subject to any disclaimer, the term of this patent is extended or adjusted under 35 U.S.C. 154(b) by 303 days.

(21) Appl. No.: 13/331,347

(22) Filed: Dec. 20, 2011

(65) Prior Publication Data

US 2013/0153380 A1 Jun. 20, 2013

(51) Int. Cl.
*H01H 21/50* (2006.01)

(52) U.S. Cl.
USPC ..... 200/321; 200/332.2

(58) Field of Classification Search
USPC ..... 200/321, 322, 331, 330, 332.2, 337
See application file for complete search history.

(56) References Cited

U.S. PATENT DOCUMENTS

| | | | | |
|---|---|---|---|---|
| 2,676,217 | A | 4/1954 | Garbs | |
| 3,564,186 | A | 2/1971 | Mittelstadt et al. | |
| 3,833,784 | A | 9/1974 | Bobel et al. | |
| 4,296,286 | A * | 10/1981 | Richardson | 200/61.88 |
| 4,845,803 | A * | 7/1989 | King | 200/330 |
| 7,600,579 | B2 | 10/2009 | Wasielewski | |

* cited by examiner

*Primary Examiner* — Briggitte R Hammond
(74) *Attorney, Agent, or Firm* — Maginot, Moore & Beck

(57) ABSTRACT

A power tool includes a linear activation switch incorporating features to prevent accidental activation. More particularly, the switch includes a switch cap that must be first rotated or pivoted before it can be linearly translated to activate the switch. The power tool includes a housing defining a guide track having a first section and an second section, offset from each other by a third section. The switch includes a switch cap having guide ribs, a first slidably disposed within the first section and a second rib one initially situated within the third section. The switch cap is pivotable about the first guide rib so that the second guide rib moves within the third section into alignment with the second section of the guide track. The switch cap can then be moved linearly with the second guide rib sliding within the second section, with this movement activating the switch.

20 Claims, 5 Drawing Sheets

ACTIVATION SWITCH FOR A POWER TOOL

FIELD OF THE INVENTION

The present disclosure relates to power tools and more particularly to activation switches for such tools.

DESCRIPTION OF THE RELATED ART

A myriad of power tools exist that are electrically powered and activated by a manual switch. One common type of switch is a linear switch that is pushed in one direction to activate the power tool and in the opposite direction to de-activate the device. It is desirable to employ a switch that is resistant to inadvertent activation, such as when the power tool is accidentally dropped or bumped against an object. Thus, some switches are recessed within the housing of the power tool. However, this switch design can be difficult to manually access, particularly when the power tool is operating.

For pistol-grip type tools, the switch can be conveniently configured as a trigger. However, more compact tools capable of more nimble operation typically utilize a linear grip in which the tool housing itself is held by the craftsman. Power tools of this type frequently use a linear switch that is pushed in one direction to activate the power tool and in the opposite direction to de-activate the device. The switch is positioned near the cord-end of the tool for easy access when the tool is in use. One problem with this typical switch is that it can be susceptible to inadvertent activation since the linear switch cannot be as effectively shielded, like the pistol grip trigger switch. There is a need for an improved switch that avoids the problem of inadvertent activation but without sacrificing ergonomics.

SUMMARY

In one aspect of the present disclosure, a switch assembly for a power tool having a housing is provided which comprises an interior track defined in the housing, the track including first and second elongated channels offset from each other by an intermediate section and an activation switch mounted within the housing adjacent the interior track, the switch including an actuator movable from a first position to a second position. In one feature, a switch cap is supported within the housing and coupled to the actuator, the switch cap movable within the housing from an initial position corresponding to the first position of the actuator to an activation position corresponding to the second position of the actuator.

The switch cap includes a first rib disposed within the first channel when the switch cap is in the initial position and a second rib disposed within the intermediate section when the switch cap is in the initial position. The first and second ribs are configured to pivot the switch cap about the first rib to an intermediate position in which the second rib is disposed within the second channel of the interior track. The first rib is configured for sliding within the first channel and the second rib is configured for sliding within the second channel to the activation position of the switch cap. The switch cap includes a portion accessible from outside the housing that is configured to be manually engaged to pivot the switch cap from the initial position to the intermediate position and then to slide the switch cap from the intermediate position to the activation position.

DETAILED DESCRIPTION

Figure 1:
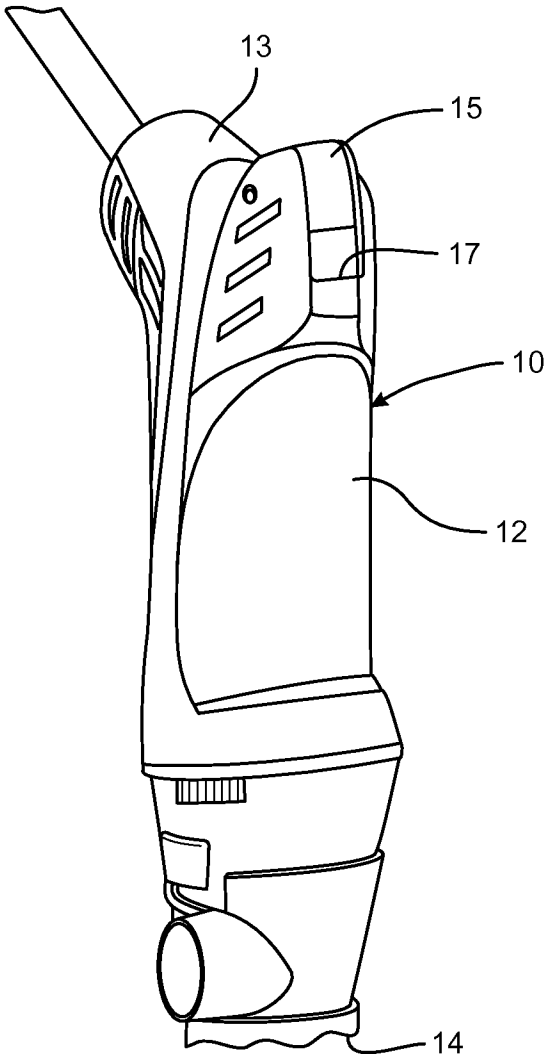
FIG. 1 is a perspective view of a power tool including a linear activation switch assembly according to the present disclosure.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

A power tool 10 shown in FIG. 1 includes an elongated housing 12. The housing is configured to be gripped by the craftsman between the cord end 13 and the working end 14. The tool may be configured to accept a variety of bits, such as a spiral saw bit. The housing contains an electrical motor (not shown) for driving the tool bit in which the motor may be an AC motor connected to a power supply by a power cord, or may be a DC motor powered by a battery pack (not shown) mounted within the housing 12. The tool 10 includes an activation switch assembly 15 that activates and de-activates the tool, or more particularly that connects and disconnects the motor to the electrical power supply. The switch assembly 15 is mounted within a recessed opening 17 in the housing 12.

Figure 2C:
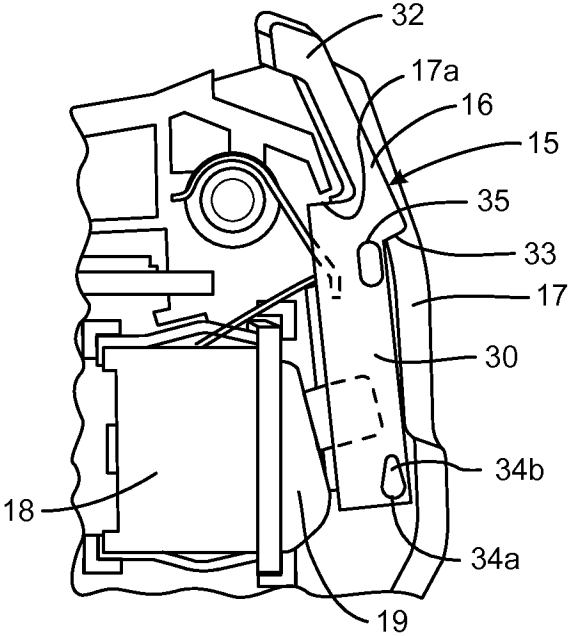
FIGS. 2*a-c* are enlarged side views of a housing half for the power tool of FIG. 1 showing the activation switch assembly of the present disclosure in three positions.
Figure 2B:
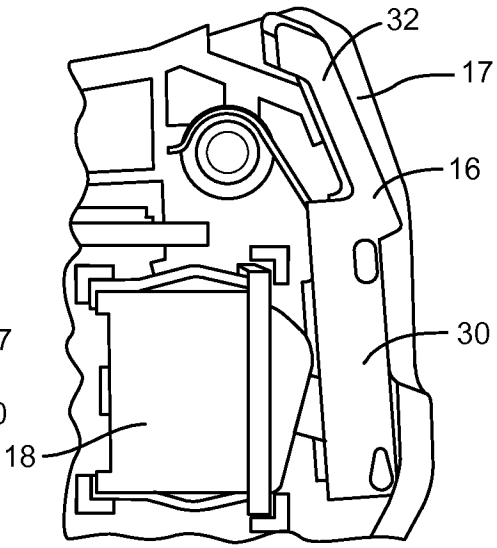
Figure 2A:
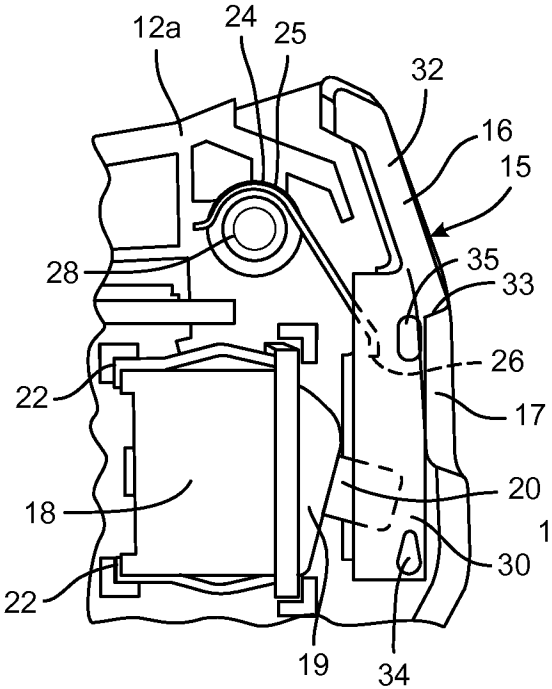
Figure 3:
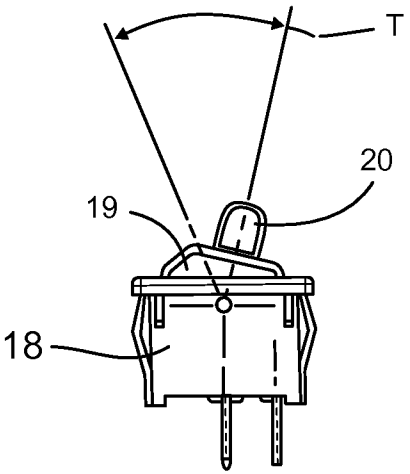
FIG. 3 is a side view of a toggle switch for use with the activation switch assembly shown in FIGS. 2*a-c*.

Details of the switch assembly 15 are shown in FIGS. 2*a*-2*c*. In particular, the switch assembly includes a switch cap 16 that engages an activation switch in the form of a toggle switch 18 mounted within the housing. The toggle switch 18 includes an actuator in the form of a toggle 19 that pivots through a throw angle T (FIG. 3) from a first "off" or de-activated position, as shown in FIG. 2*a*, to a second "on" or activated position, as shown in FIG. 2*c*. The toggle 19 includes a post 20 projecting therefrom that engages the cap 16 as described herein. The switch cap 16 is mounted within the housing 12 for linear actuation. When the cap 16 is in the position shown in FIG. 2*a*, the cap is wholly contained within the switch opening 17, as depicted in FIG. 1. When it is desired to activate the power tool 10, the switch cap 16 is moved toward the cord end 13 of the housing, as illustrated in FIG. 2*c*. This movement of the switch cap moves the switch actuator toggle 19 from the "off" position to the "on" position.

As thus far described, the switch assembly is similar to other linear switches in that linear movement of the switch cap turns the power tool on and off. However, in order to prevent inadvertent activation of the switch, or accidental sliding of the switch, the switch assembly 15 is configured so that the switch cap 16 must first be rotated before it can be translated to move the toggle 19, as illustrated in FIGS. 2*a*-2*c*. The switch cap 16 is shown in its baseline position fully contained within the opening 17 in the housing 12. In this position the toggle switch 18 is in the "off" position. A biasing member 24 is configured to push the switch cap outward to this baseline position. In one embodiment the bias member is a spring, such as a leaf spring as depicted in FIG. 2*a*. The base 25 of the biasing member is fixed within a spring mount 28 defined in the housing 12, while a foot 26 of the biasing member bears against the switch cap 16. It can be appreciated that the view of FIG. 2*a* represents one half 12*a* of the housing, with the other half being substantially identical so that when the two halves 12*a* are joined the biasing member, as well as the toggle switch and switch cap, are captured within the housing.

Figure 4:
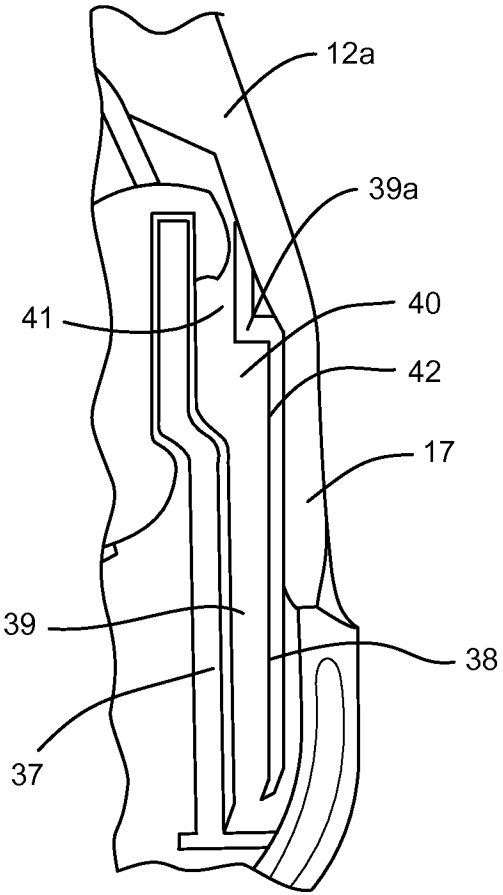
FIG. 4 is an enlarged side view of the housing half used with the activation switch assembly shown in FIGS. 2*a-c*.

The housing and switch cap are configured to prevent the switch cap 16 from being pushed out of the housing by the biasing member. More particularly, the housing defines an interior guide track 38 (FIG. 4), and the switch cap includes first and second guide ribs 34, 35, respectively (FIGS. 5*a*-5*b*), that are slidably disposed within the track. The guide track 38 may be formed between an interior wall 37 and an outboard wall 42 immediately adjacent the switch cap opening 17. As depicted in FIG. 4, the track extends along the length of the tool and housing half 12*a* (it being understood that the other housing half includes a similarly configured track). The walls 37 and 42 of the housing are configured so that the track 38 includes a first channel 39, an intermediate section 40 and a second channel 41. The two channels may be substantially linear and generally parallel to each other. The intermediate section 40 communicates between both channels and may be generally perpendicularly oriented relative to the two channels.

The switch cap is in the baseline, of "off" position (FIG. 2*a*) when the switch cap is aligned within the first channel 39 of the guide track. The first channel has a length that is slightly less than the distance between the guide ribs 34, 35 on the switch cap so that the switch cap can pivot, as described in more detail herein. The first guide rib 34 is thus fully seated within the first channel 39 of the track while the second guide rib 35 is situated beyond the end of the first channel. In the illustrated embodiment the first and second channels are linear so that the switch cap can move in a linear fashion during activation and deactivation of the power tool.

Figure 5B:
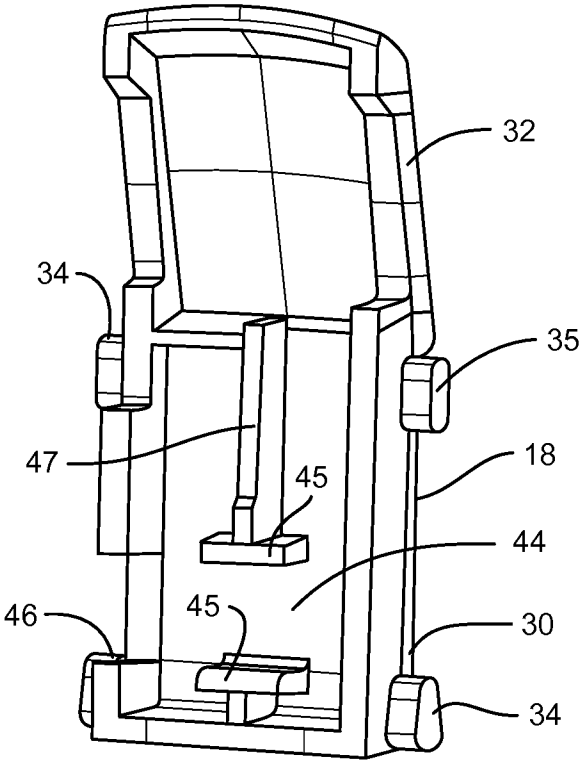
FIGS. 5*a-b* are front and rear perspective views of a switch cap used with the activation switch assembly shown in FIGS. 2*a-c*.
Figure 5A:
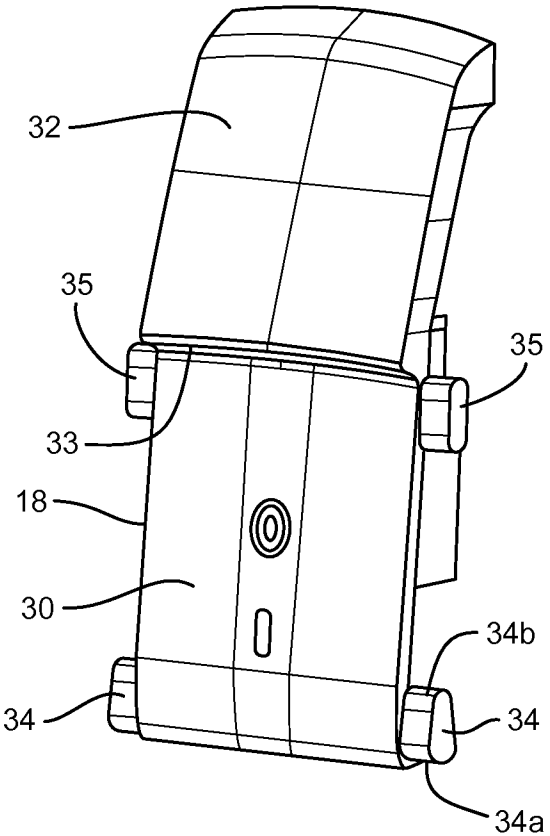

Referring to FIGS. 5*a*-5*b*, the switch cap includes a body 30 from which the guide ribs 34, 35 project laterally outward. The switch cap further includes a manually accessible portion 32 that is offset from the body at a relief 33. The underside of the cap is configured to engage the biasing member 24 and the toggle 19 of the toggle switch 18. Thus, the cap defines a toggle recess 44 between two walls 45 that is sized to accept the toggle post 20 therein. An access opening 46 may be provided in the side of the cap to facilitate assembly of the switch cap and toggle switch within the housing halves 12*a*. The cap further defines an interior wall 47 against which the foot 26 of the biasing member 24 bears. The interior wall 47 of the cap slides along the foot of the biasing member 24 when the cap is rotated and translated, while the biasing member maintains a continuous outward pressure on the switch cap.

The switch cap 16 is in its initial or first position shown in FIG. 5*a* corresponding to the first "on" position of the switch 18. As suggested above, in order to activate the tool 10, the switch cap 16 is first depressed against the biasing member 24 toward the interior of the housing 12. The guide track 38 of the housing includes an intermediate section 40, or pivot section, at the end of the first channel 39, with the second guide rib 35 residing within the intermediate section. When the manual portion 32 of the switch cap is depressed to an intermediate position, the second guide rib 35 moves inward through the intermediate/pivot section 40 until it is aligned with the second or activation channel 41. In order to accommodate this pivoting movement, the first guide rib 34 that is situated within the first channel operates as a pivot fulcrum and may be accordingly configured in a teardrop shape, tapering from one end 34*a* to the opposite end 34*b*. This tapered shape allows the guide rib to maintain a close sliding fit within the guide track 38 yet still accommodate pivoting of the switch cap. In the initial position the tapered first rib 34 is oriented generally parallel to the length of the guide track 38, while in the pivoted intermediate and activation positions shown in FIGS. 2*b*-2*c* the tapered rib is canted at an angle relative to the guide track. With this tapered configuration of the first guide rib 34, the first channel 39 of the guide track can have a constant width that provides a close running fit between the rib and the track. The second guide rib 35 may be oblong, as shown in FIGS. 2*a*-*c*. Since the second guide rib 35 only translates within the second channel 41 the width of the channel 41 and the orientation of the rib 35 may be coordinated to provide a close running fit.

It can be appreciated that until the switch cap is pivoted, as shown in FIG. 2*b*, the second guide rib 35 butts against a stop surface 39*a* (FIG. 4) at the end of the first channel 39 of the guide track. With the biasing member 24 pushing the switch cap outward the cap is positively restrained from moving longitudinally to a position in which the toggle switch is activated. However, once the manual portion 32 is depressed, the second guide rib 35 falls into the second channel 41 of the guide track in which the cap is now free to slide toward the end of the tool to the activated position, as depicted in FIG. 2*c*. With the second guide rib 35 in the second channel and the first guide rib 34 in the first channel, the switch cap 16 is translated by pushing the manual portion 32 upward toward the end of the tool. The toggle post 20 moves with the switch cap since it is engaged within the toggle recess 44, and this movement causes the toggle 19 to pivot to the "on" position shown in FIG. 2*c*. The switch cap opening 17 in the housing is configured to prevent the switch cap from sliding out of the housing when it is moved to its activation position. Thus, the opening may be provided with a stop edge 17*a* that the relief portion 33 of the switch cap 16 may contact to prevent further movement of the cap. Alternatively, the second channel 41 may be provided with a stop surface against which the second rib 35 may contact.

When the switch cap is in the activated position, the biasing member 24 attempts to push the switch cap back to its initial position. However, the second rib 35 is constrained within the second channel 41 of the guide track 38 so the switch cap is unable to pivot back to the initial position. The pressure of the biasing member can be sufficient to prevent the switch cap from translating back toward the intermediate section 40. In addition, or alternatively, the activation switch 18 may hold the switch cap in its activation position.

The configuration of the two channels of the guide track 38 and the two offset ribs 34, 35 prevent the switch cap 16 from being accidentally moved to the activated position. In the initial or "off" position (FIG. 2*a*) the switch cap cannot be advanced within the first channel 34 because the second rib 35 will contact the stop 42 at the end of the first channel. Moreover, although the switch cap may be inadvertently depressed so that the cap pivots to its intermediate position (FIG. 2*b*), the toggle switch 18 coupled to the switch cap cannot be moved to its "on" position. It is only with the additional linear movement of the switch cap from the intermediate position to the activation position (in which the second rib 35 slides within the second channel 41) that the toggle switch can be flipped to its "on" position shown in FIG. 2*c*.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected. For instance, the switch cap 16 is described as translating upward or toward the cord end 15 of the tool 10. The switch cap movement may be reversed so that the switch cap is translated downward toward the bit end 14, with appropriate changes to the orientation of the guide track 38 and toggle switch 18. In addition, the guide track 38, and particularly the first and second channels 39, 41, may be non-linear or arcuate while still preserving the linear activation aspect of the switch cap.

Figures 6A, 6B, 6C:
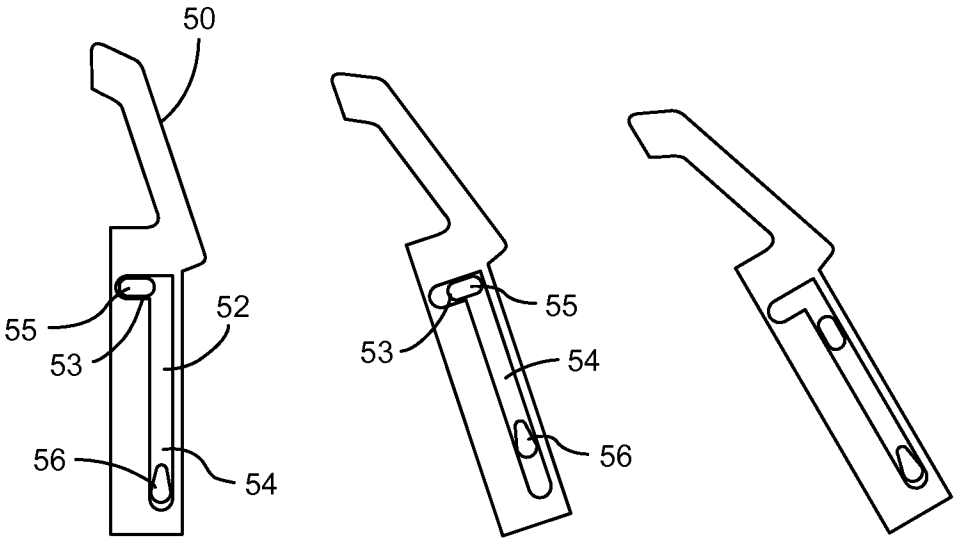
FIGS. 6*a-c* are representations of an alternative guide track and guide rib arrangement for a linear activation switch assembly, showing the arrangement in three positions.

Moreover, in the illustrated embodiment the guide track 38 is defined in the housing 12 while the guide ribs 34, 35 are formed on the switch cap. Alternatively the track may be defined in a side wall of the switch cap and the ribs may project inward from an interior face of each housing half 12*a*. With this modification the guide track in the switch cap may be L-shaped, as depicted in FIGS. 6*a*-6*c*. In particular, a modified switch cap 50 includes an L-shaped guide track 52 with a first channel 53 and a second channel 54. A modified housing includes two guide ribs 55 and 56 with the rib 55 initially disposed in the first channel 53 of the guide track, corresponding to the "off" position of the toggle switch. The rib 56 is slidably disposed within the second channel 54. When the switch cap 50 is depressed or pivoted inward the guide rib 55 moves into the second channel 54 with the switch cap canted within the housing due to the offset alignment of the two guide ribs, as shown in FIG. 6*b*. The switch cap is then free to translate toward the end of the tool to flip the toggle switch, while the two ribs 55, 56 are slidably disposed within the second channel 54, as illustrated in FIG. 6*c*.

In addition, the power tool 10 disclosed herein utilizes a toggle switch 18, although other types of activation switches are contemplated, with appropriate modifications to the switch cap 16. For instance the switch may be a push button switch and the switch cap may be modified to incorporate a cam surface to depress the push button upon rotation and translation (or upward movement) of the cap. Other switch and switch cap arrangements are contemplated provided they incorporate the rotation or pivoting feature described herein.

What is claimed is:

1. A switch assembly for a power tool, the power tool having a housing, said switch assembly comprising:

an interior track defined in the housing, said track including first and second elongated channels offset from each other by an intermediate section;

an activation switch mounted within the housing adjacent said interior track, said switch including an actuator movable from a first position to a second position;

a switch cap supported within the housing and coupled to said actuator, said switch cap movable within the housing from an initial position corresponding to said first position of said actuator to an activation position corresponding to said second position of said actuator, said switch cap including a first rib disposed within said first channel when said switch cap is in said initial position and a second rib disposed within said intermediate section when said switch cap is in said initial position, said first and second ribs configured to pivot said switch cap about said first rib to an intermediate position in which said second rib is disposed within said second channel of said interior track;

said first rib configured for sliding within said first channel and said second rib configured for sliding within said second channel to said activation position of said switch cap; and said switch cap including a portion accessible from outside the housing and configured to be manually engaged to pivot said switch cap from said initial position to said intermediate position and to slide said switch cap from said intermediate position to said activation position.

2. The switch assembly of claim 1, further comprising a biasing member disposed within the housing operably disposed between the housing and said switch cap, said biasing member configured to bias said switch cap against pivoting to said intermediate position.

3. The switch assembly of claim 2, wherein said biasing member is a leaf spring having a base mounted within the housing and a foot bearing against said switch cap.

4. The switch assembly of claim 1, wherein said first channel includes a stop adjacent said intermediate section arranged so that said second rib abuts said stop when said switch cap is in said initial position.

5. The switch assembly of claim 1, wherein said first and second channels are substantially linear and substantially parallel to each other.

6. The switch assembly of claim 5, wherein said intermediate section is generally perpendicular to and communicates between said first and second channels.

7. The switch assembly of claim 1, wherein said first rib is tapered toward said second rib.

8. The switch assembly of claim 1, wherein:

said activation switch is a toggle switch having a toggle movable between said first and second positions of said activation switch, said toggle including a post projecting toward said switch cap; and sad switch cap defines a recess configured to receive said post.

9. The switch assembly of claim 1, wherein:

two opposing interior tracks are defined in opposite sides of the housing; and said switch cap includes two first ribs on opposite sides of said switch cap for engaging said two interior tracks and two second ribs on opposite sides of said switch cap for engaging said two interior tracks.

10. A power tool comprising:

an electrical motor connected to a power supply;

a housing configured to house said motor and defining an interior track defined in said housing, said track including first and second elongated channels offset from each other by an intermediate section;

an activation switch coupled between said motor and the power supply and mounted within said housing adjacent said interior track, said switch including an actuator movable from a first position to a second position;

a switch cap supported within the housing and coupled to said actuator, said switch cap movable within the housing from an initial position corresponding to said first position of said actuator to an activation position corresponding to said second position of said actuator, said switch cap including a first rib disposed within said first channel when said switch cap is in said initial position and a second rib disposed within said intermediate section when said switch cap is in said initial position, said first and second ribs configured to pivot said switch cap about said first rib to an intermediate position in which said second rib is disposed within said second channel of said interior track;

said first rib configured for sliding within said first channel and said second rib configured for sliding within said second channel to said activation position of said switch cap; and said switch cap including a portion accessible from outside said housing and configured to be manually engaged to pivot said switch cap from said initial position to said intermediate position and to slide said switch cap from said intermediate position to said activation position.

11. The power tool of claim 10, further comprising a biasing member disposed within the housing operably disposed between the housing and said switch cap, said biasing member configured to bias said switch cap against pivoting to said intermediate position.

12. The power tool of claim 11, wherein said biasing member is a leaf spring having a base mounted within the housing and a foot bearing against said switch cap.

13. The power tool of claim 10, wherein said first channel includes a stop adjacent said intermediate section arranged so that said second rib abuts said stop when said switch cap is in said initial position.

14. The power tool of claim 10, wherein said first and second channels are substantially linear and substantially parallel to each other.

15. The power tool of claim 14, wherein said intermediate section is generally perpendicular to and communicates between said first and second channels.

16. The power tool of claim 10, wherein said first rib is tapered toward said second rib.

17. The power tool of claim 10, wherein:

said activation switch is a toggle switch having a toggle movable between said first and second positions of said activation switch, said toggle including a post projecting toward said switch cap; and sad switch cap defines a recess configured to receive said post.

18. A switch assembly for a power tool, the power tool having a housing, said switch assembly comprising:

an activation switch mounted within the housing, said activation switch including an actuator movable from a first position to a second position;

a switch cap supported within the housing and coupled to said actuator, said switch cap movable within the housing from an initial position corresponding to said first position of said actuator to an activation position corresponding to said second position of said actuator, a track defined in one of the housing and said switch cap, said track including first and second elongated channels offset from each other by an intermediate section;

a pair of ribs associated with the other of the housing and said switch cap, said pair of ribs including a first rib disposed within said first channel when said switch cap is in said initial position and a second rib disposed within said intermediate section when said switch cap is in said initial position, said first and second ribs configured to pivot said switch cap about said first rib to an intermediate position in which said second rib is disposed within said second channel of said interior track;

said first rib configured for sliding within said first channel and said second rib configured for sliding within said second channel to said activation position of said switch cap; and said switch cap including a portion accessible from outside said housing and configured to be manually engaged to pivot said switch cap from said initial position to said intermediate position and to slide said switch cap from said intermediate position to said activation position.

19. The switch assembly of claim 18, further comprising a biasing member disposed within the housing operably disposed between the housing and said switch cap, said biasing member configured to bias said switch cap against pivoting to said intermediate position.

20. The switch assembly of claim 18, wherein:

said first and second channels are substantially linear and substantially parallel to each other; and said intermediate section is generally perpendicular to and communicates between said first and second channels.

* * * * *